US011435767B2

(12) United States Patent
Helmy Zaky et al.

(10) Patent No.: US 11,435,767 B2
(45) Date of Patent: Sep. 6, 2022

(54) VOLTAGE REGULATOR AND BANDGAP VOLTAGE REFERENCE WITH NOVEL START-UP CIRCUIT AND SEAMLESS VOLTAGE REFERENCE SWITCH OVER FOR PSR ENHANCEMENT

(71) Applicant: Vidatronic, Inc., College Station, TX (US)

(72) Inventors: Bishoy Milad Helmy Zaky, Cairo (EG); Anand Veeravalli Raghupathy, Dallas, TX (US)

(73) Assignee: Vidatronic, Inc., College Station, TX (US)

( * ) Notice: Subject to any disclaimer, the term of this patent is extended or adjusted under 35 U.S.C. 154(b) by 0 days.

(21) Appl. No.: 16/446,488

(22) Filed: Jun. 19, 2019

(65) Prior Publication Data

US 2020/0401167 A1 Dec. 24, 2020

(51) Int. Cl.
*G05F 1/46* (2006.01)
*G05F 3/16* (2006.01)

(52) U.S. Cl.
CPC . *G05F 1/46* (2013.01); *G05F 3/16* (2013.01)

(58) Field of Classification Search
CPC ..... G05F 1/45; G05F 3/16; G05F 1/10; G05F 1/267; G05F 1/46; G05F 1/561; G05F 1/567; G05F 1/569; G05F 1/571; G05F 1/573; G05F 1/5735; G05F 1/461; G05F 1/462; G05F 1/463; G05F 1/465; G05F 1/466; G05F 1/467; G05F 1/56; G05F 1/562; G05F 1/563; G05F 1/565; G05F 1/575; G05F 1/577; G05F 1/585; G05F 1/59; G05F 1/595; G05F 1/607; G05F 1/61; G05F 1/613; G05F 1/614; G05F 1/618; G05F 1/62; G05F 1/66; G05F 1/08; G05F 1/153; G05F 1/16; G05F 1/26; G05F 1/34; G05F 3/02; G05F 3/30; G05F 3/22; G05F 3/222; G05F 3/242; G05F 3/225; G05F 3/245; G05F 3/20; G05F 3/00; G05F 3/08; G05F 3/10; G05F 3/18; G05F 3/185;

(Continued)

(56) References Cited

U.S. PATENT DOCUMENTS 10,866,605 B2 * 12/2020 Zhao ..... H02M 3/33561
2005/0046405 A1 * 3/2005 Trafton et al. ..... H03M 1/0845 341/150

(Continued)

*Primary Examiner* — Bryan R Perez
(74) *Attorney, Agent, or Firm* — Liang Legal Group, PLLC

(57) ABSTRACT

A voltage regulation loop includes a voltage reference generation block that includes a bandgap voltage reference circuit; a linear voltage regulator block that includes a first and second linear voltage regulators, wherein the first linear voltage regulator provides a first regulated power supply to the bandgap voltage reference circuit in the voltage reference generation block, and the second linear voltage regulator provides a second regulated power supply to a load; and a soft startup circuit connected between the voltage reference generation block and the linear voltage regulator block, wherein a selector functions with a control block to output a selected voltage reference to pass to the soft startup circuit, wherein the soft startup circuit smooths the selected voltage reference and produces a smoothed voltage reference to pass to the linear voltage regulator block to prevent overshoots at startup.

20 Claims, 15 Drawing Sheets

(58) Field of Classification Search
CPC . G05F 3/227; G05F 3/247; G05F 3/26; G05F 3/265; G05F 3/24; G05F 3/262
USPC ..... 323/281
See application file for complete search history.

(56) References Cited

U.S. PATENT DOCUMENTS

| | | | | |
|---|---|---|---|---|
| 2009/0115379 | A1* | 5/2009 | Al-Shyoukh | G05F 1/56 323/238 |
| 2015/0241890 | A1* | 8/2015 | Raychowdhury | G05F 1/56 713/300 |
| 2016/0091907 | A1* | 3/2016 | Su | G05F 1/46 323/280 |
| 2019/0146530 | A1* | 5/2019 | Kotrc | G05F 1/575 323/265 |

* cited by examiner

1300

VOLTAGE REGULATOR AND BANDGAP VOLTAGE REFERENCE WITH NOVEL START-UP CIRCUIT AND SEAMLESS VOLTAGE REFERENCE SWITCH OVER FOR PSR ENHANCEMENT

BACKGROUND

A linear low-dropout voltage regulator (LDO) is a circuit that converts an unregulated DC supply into a well-regulated one, always using a closed loop control and a clean voltage reference that is usually independent of the temperature, process and supply variations. While the LDO output is primarily only a function of the voltage reference, it still has some noise (ripples) coupled from the supply noise. That is why the power supply rejection (PSR) is an important specification for linear voltage regulators. The PSR is a measure of how well the LDO rejects the supply noise (ripples), in order to have a well-regulated output that is not affected by the supply variations or noise.

FIG. 1A shows a schematic block level diagram of a prior art linear voltage regulator (100). It illustrates the possible paths that couple the supply noise (ripples) to the output of the regulator affecting the PSR at its output. There are four paths for the noise coupled from the supply to the output of the LDO. Path (101) includes the supply noise coupled to the LDO output through the parasitic source to drain capacitance (Csd) of the pass transistor. Path (102) includes the supply noise coupled to the LDO output through the effective source to drain resistance of the pass transistor. Path (103) includes the supply noise coupled to the LDO output from the error amplifier supply. Path (104) includes the supply noise coupled to the LDO output due to the supply noise coupled on the voltage reference itself (because the voltage reference will also have some supply noise coupled on it).

FIG. 1B shows the effect of each path on the LDO output PSR for the regulator shown in FIG. 1A. Curve (108) shows the overall PSR. Curve (105) shows the effect of paths (101) and (102) on the PSR. The paths 101 and 102 dominate the PSR at high frequencies. Curve (106) shows the effect of path (103) on the PSR. Curve (107) shows the effect of path (104) on the PSR. Path (104) dominates and limits the PSR at low frequencies. Thus, the voltage reference PSR is very important as it limits the PSR of the LDO output at low frequencies. So, we can conclude that it is essential to generate a high PSR voltage reference first in order to generate a high PSR regulated LDO output.

FIG. 2 shows a prior art linear voltage regulator (200), wherein the voltage reference coming from the bandgap voltage reference circuit BGR (201) is filtered using an RC filter (202) before going to the error amplifier (205) in the regulator. The aim of the RC filter (202) is to enhance the PSR of the voltage reference to improve the PSR of the LDO output. One drawback of this method is that the values of R (203) and C (204) are very large in order to have the filter's cutoff frequency at low frequencies. This requires large silicon area to implement the Resistor and the Capacitor on-die, or else external components on the Printed Circuit Board (PCB) must be used (the external components add cost and size to the overall solution). A second drawback is the long time that it takes for the voltage reference to settle, which can be a detriment in some systems.

FIG. 3 shows another example of a prior art regulation loop (300) containing a linear voltage regulator block (305) and two voltage reference generators: a first voltage reference generator (301) and a second voltage reference generator (310). In such a loop, the first voltage reference generator (301) is powered from VDD to generate a first voltage reference (Vref1) that is used by the linear voltage regulator LDO block (305) to start up and reach stable operation. The linear voltage regulator LDO supplies a regulated voltage (Vreg) to the second voltage reference generator (310) to generate a second voltage reference (Vref2). Then, the reference and power switcher block (303) will switch at the same time both the voltage reference going to the regulator (305) (from Vref1 to Vref2) and the supply of a portion of the linear voltage regulator (320) (from VDD to Vreg).

The architecture described in FIG. 3 (300) has many disadvantages. First, there is a risk that there could be a drop in the voltage reference going to the linear voltage regulator block LDO (305) at the time of switching from Vref1 to Vref2 (unless a smooth switching scheme is used), causing the output of the regulator (Vreg) to also drop. A second disadvantage of the architecture is that it needs to switch both the voltage reference going to the linear voltage regulator (305) (from Vref1 to Vref2) and the supply of a portion of the regulator (320) (from VDD to Vreg) at the same time. This could introduce additional droops or glitches in the output. A third disadvantage is that the VDD power to the first voltage reference generator (301) is not shut down even after switching, wasting quiescent power. A fourth disadvantage is that the system has only one linear voltage regulator (305) generating one Vreg, which will be used as a power supply for the Vreg powered second voltage reference generator (310) and other loads. This can cause a problem when one of the other loads taking its supply from (Vreg) is a switching load causing some spikes and variations in Vreg, which in turn can affect the Vreg powered second voltage reference generator output (Vref2). A fifth disadvantage is that the linear voltage regulator (305) will need to be designed with a large pass transistor to support all the loads of the circuit and this leads to bad PSR of that regulator (compared to other regulators with small pass transistors). A sixth limitation in this architecture is that the (Vref1) and (Vref2) must have equal values for correct operation, because if (Vref2) is different from (Vref1), the output of the linear voltage regulator (305) (Vreg) will experience a sudden change at the moment of switching between the voltage references. This in turn can affect Vref2 itself (because it comes from Vreg powered second voltage reference generator (310)) and can also affect the other loads taking the supply from Vreg at that time. A seventh disadvantage is that there is no soft startup circuit for the linear voltage regulator (305), which may lead to some overshoots at the output of the regulator (305) Vreg at the startup, which may affect Vref2. Therefore, there is still a need for better linear voltage regulators.

SUMMARY OF INVENTION

Embodiments of the invention relate to novel solutions for linear voltage regulators that can achieve very high PSRs without the need for large filters. Embodiments of the invention are low-cost and high-performance voltage regulators with smooth output voltages and very high PSRs without the need for any external components.

One aspect of the invention relates to a regulation loop that includes a bandgap voltage reference circuit, a linear voltage regulator, and other blocks. A voltage regulation loop in accordance with one embodiment of the invention includes a voltage reference generation block that includes at least one bandgap voltage reference circuit (BGR); a linear voltage regulator block that includes a first and a second linear voltage regulators (LDO1 and LDO2), wherein the first linear voltage regulator (LDO1) provides a first regulated power supply (Vreg1) to the bandgap voltage reference circuit in the voltage reference generation block, and the second linear voltage regulator (LDO2) provides a second regulated power supply (Vreg2) to a load; and a soft startup circuit connected between the voltage reference generation block and the linear voltage regulator block, wherein a selector functions with a control block to output a selected voltage reference to pass to the soft startup circuit, wherein the soft startup circuit smooths the selected voltage reference and produces a smoothed voltage reference to pass to the linear voltage regulator block to prevent overshoots at startup.

In accordance with some embodiments of the invention, a voltage regulation loop as described above include two bandgap voltage reference circuits (BGR1 and BGR2) and the selector is a voltage reference selector that selects from two different voltage references (Vref1 and Vref2) generated by BGR1 and BGR2, respectively.

In accordance with some embodiments of the invention, a voltage regulation loop as described above includes one bandgap voltage reference circuits (BGR) and a selector. The selector is a power supply selector that selects from the system power supply or the first regulated voltage (Vreg1) generated by the first linear voltage regulator (LDO1) to power the BGR.

BRIEF DESCRIPTION OF DRAWINGS

The appended drawings illustrate several embodiments of the invention and are not to be considered limiting of its scope, for the invention may admit to other equally effective embodiments.

DETAILED DESCRIPTION

Figure 1B:
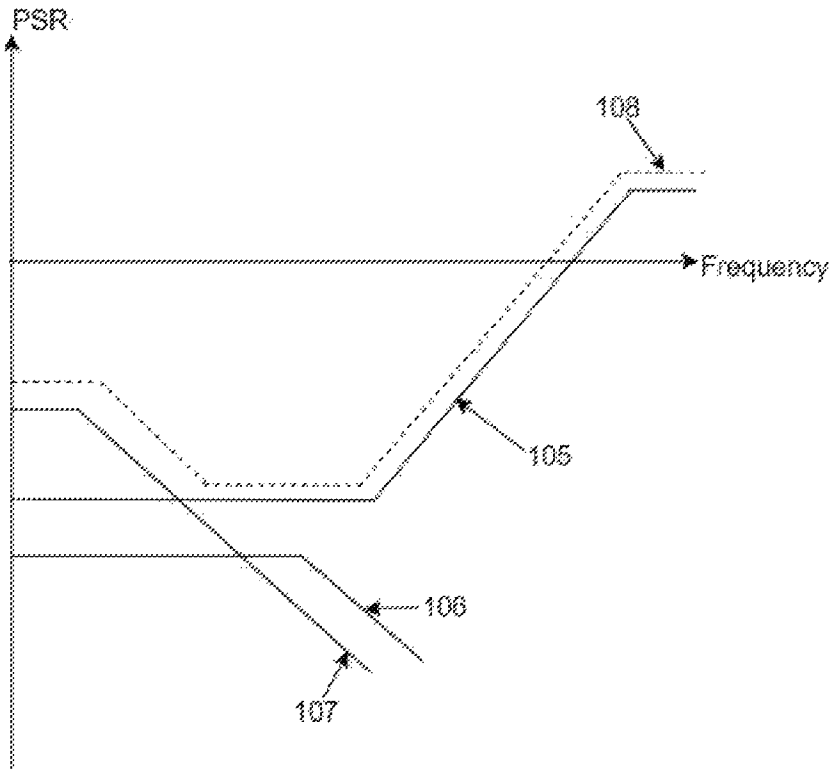
FIG. 1B (Prior Art)
FIG. 1B shows a graph of power supply rejection (PSR) versus frequency for the linear voltage regulator of FIG. 1A, indicating the effects of each path on the PSR at the LDO output.
Figure 1A:
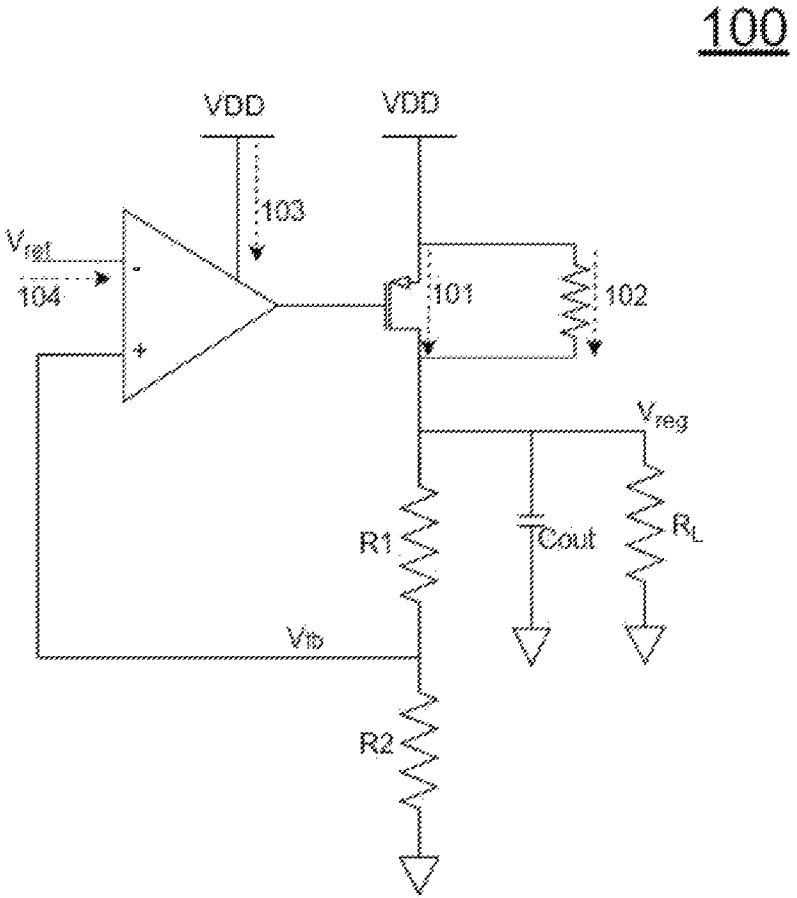
FIG. 1A (Prior Art)
FIG. 1A shows a schematic block level circuit diagram of a prior art linear voltage regulator (LDO) circuit showing possible paths that couple the supply noise to the output of the regulator affecting the PSR at its output.
Figure 2:
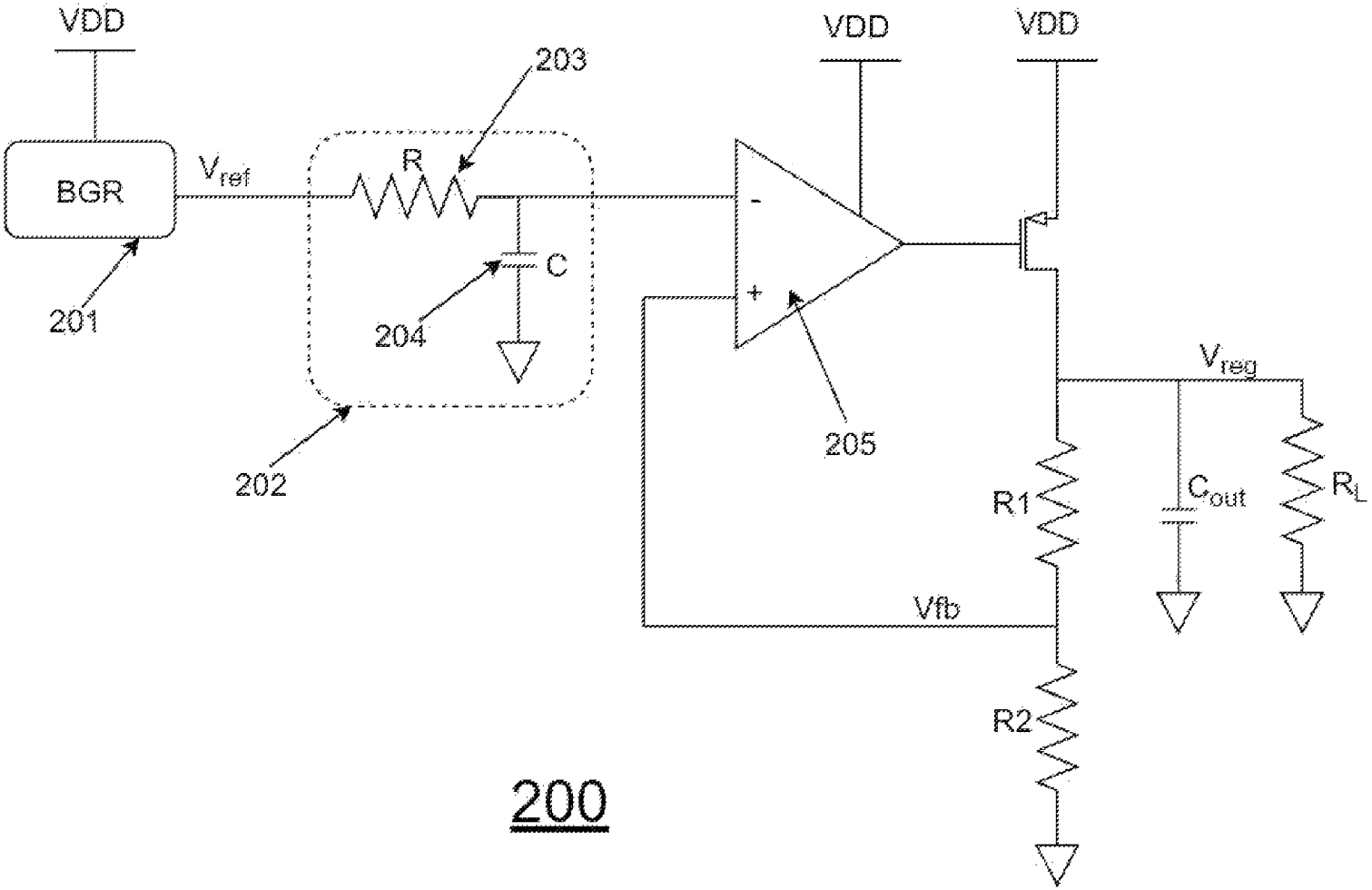
FIG. 2 (Prior Art)
FIG. 2 shows a schematic block level circuit diagram of a prior art linear voltage regulator (LDO) circuit wherein the voltage reference is filtered using an RC filter before going to the LDO.
Figure 3:
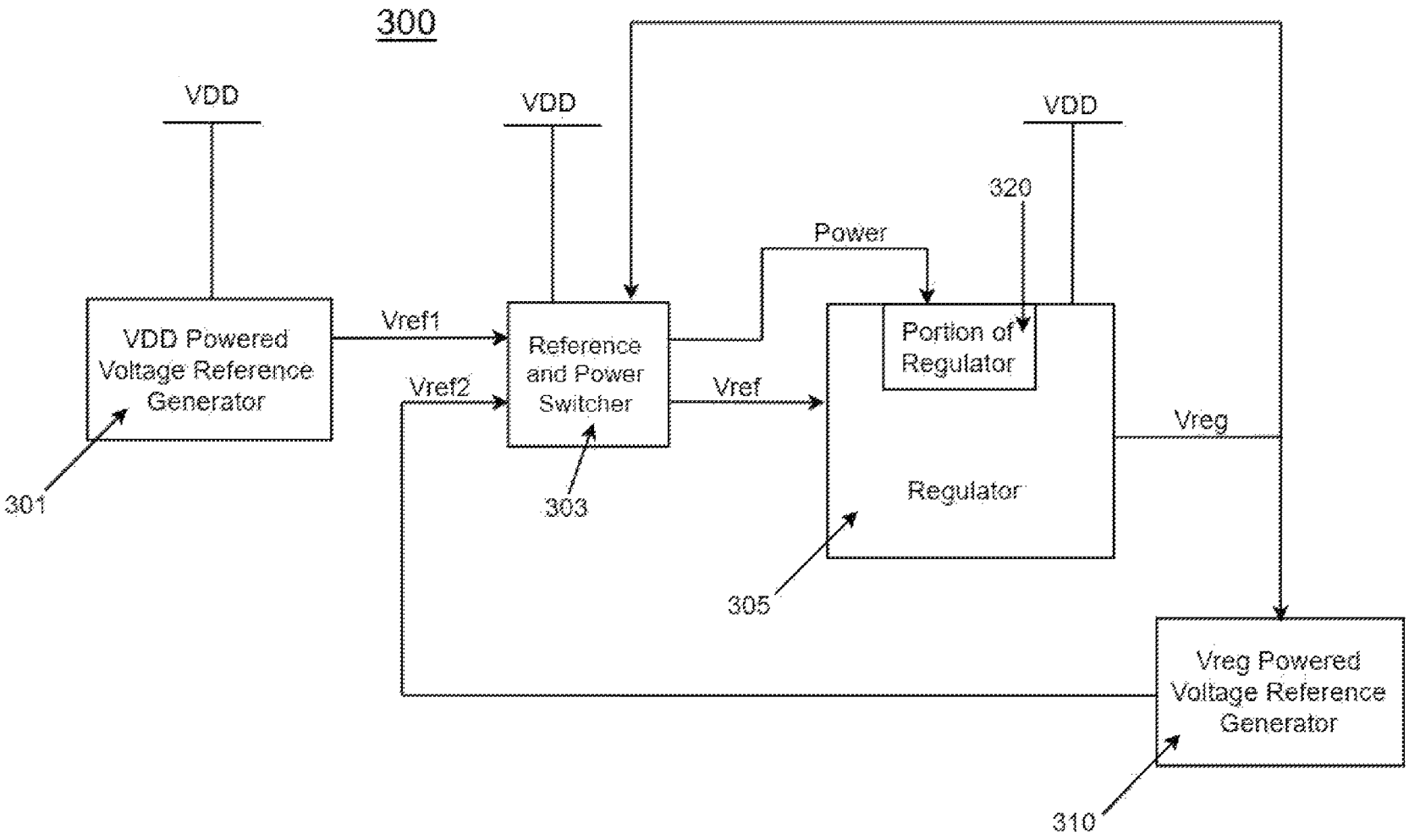
FIG. 3 (Prior Art)
FIG. 3 shows a block level circuit diagram of a prior art voltage regulation loop that includes two bandgap voltage reference generators, a power supply and voltage reference switcher block, and a linear voltage regulator.

Aspects of the present invention are shown in the above-identified drawings and are described below. In the description, like or identical reference numerals are used to identify common or similar elements. The drawings are not necessarily to scale and certain features may be shown exaggerated in scale or in schematic in the interest of clarity and conciseness.

Embodiments of the invention relate to linear voltage regulators that have smooth outputs and high PSRs, without using a large filter or other external components. In the following description, embodiments of the invention will be illustrated with specific examples. However, one skilled in the art would appreciate that other modifications and variations are possible without departing from the scope of the invention.

Figure 4A:
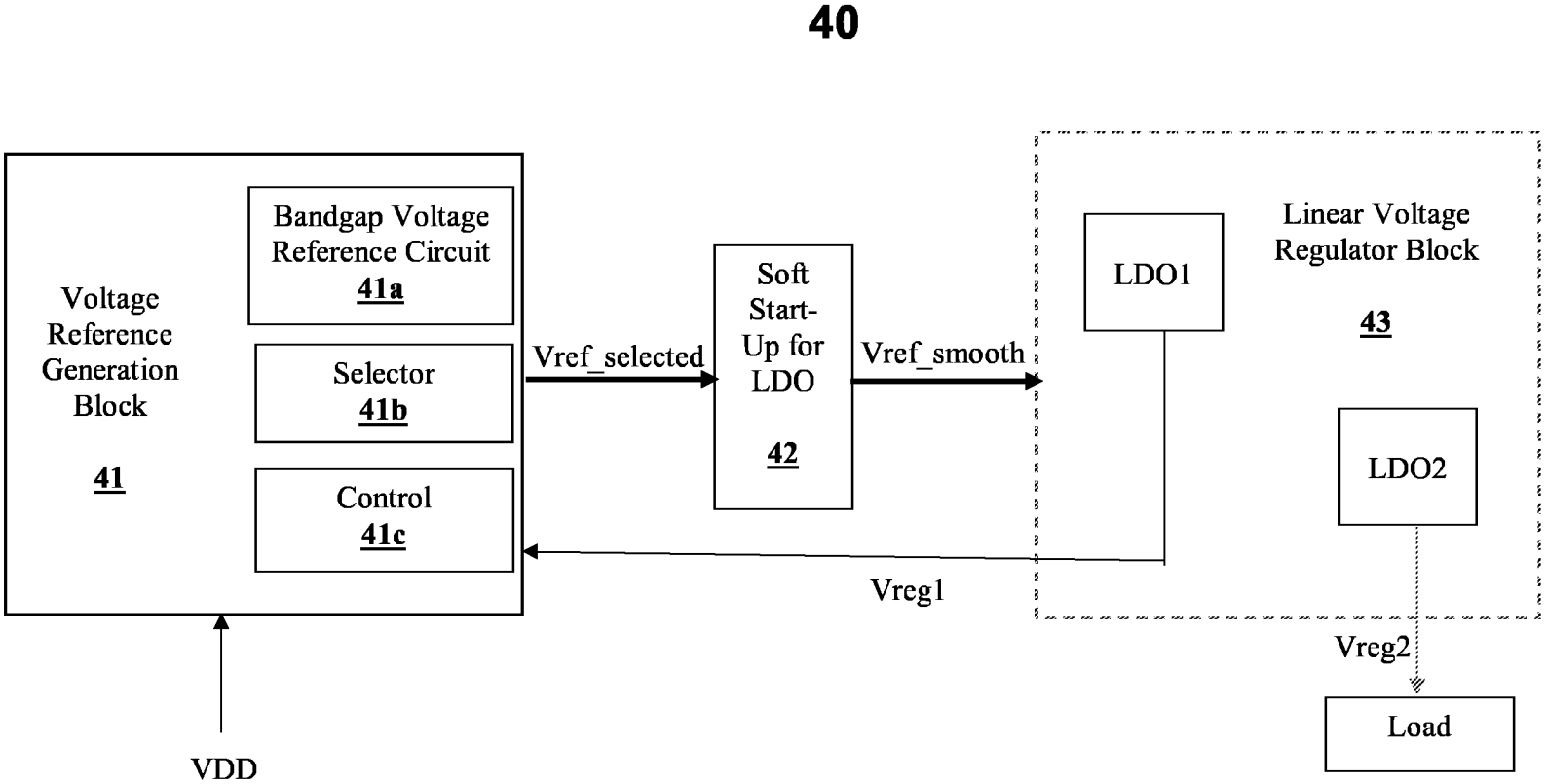
FIG. 4A shows a block level diagram of a voltage regulation loop in accordance with embodiments of the invention. A voltage regulation loop of the invention includes a voltage reference generation block, a soft startup for the LDOs, and a linear voltage regulator block.

As shown in FIG. 4A, a voltage regulation loop (40) in accordance with embodiments of the invention comprises: a reference voltage generation block (41), a soft startup circuit for LDO (42), and a Linear Voltage Regulator block (43). The reference voltage generation block (41) may comprise one or two bandgap voltage reference circuits (41*a*), a selector block (41*b*), and a control block (41*c*). The one or two bandgap voltage reference circuits (41*a*) generate one or two independent voltage references. The voltage references may be independent of the supply, temperature, and process corners.

The selector block (41*b*) functions with the control block (41*c*) to provide a selected voltage reference to pass to the soft startup circuit for LDO (42). In some embodiments with a single bandgap voltage reference circuit, the selector block (41*b*) comprises a power supply selector that selects from different power sources (either the system power or a regulated power from LDO1) to provide to the one bandgap voltage reference circuit. In other embodiments with two bandgap voltage reference circuits (BGR1 and BGR2), the selector block (41*b*) comprises a voltage reference selector that selects from different outputs of the two bandgap voltage reference circuits (BGR1 and BGR2) to provide the selected voltage reference to the soft startup circuit (42).

The soft startup circuit for LDO (42) takes the selected voltage reference (Vref_selected) and smooths it to generate a smoothed voltage reference (Vref_smooth) to power the linear voltage regulators (LDO1 and LDO2) in the linear voltage regulator block (43). In this manner, the soft startup circuit for LDO (42) ensures smooth startup and operation of the voltage regulation loop (40).

The linear voltage regulator block (43) comprises two linear voltage regulators (LDO1 and LDO2). Each of the two linear voltage regulators (LDO1 and LDO2) can have any architecture known in the art for a low dropout linear voltage regulator. For example, each of the two linear voltage regulators (LDO1 and LDO2) may comprise one or more error amplifiers and a pass transistor. The pass transistor used in each of the linear voltage regulators (LDO1 and LDO2) may be an NMOS or a PMOS transistor, a PNP or NPN transistor, or a FinFET device. The two linear voltage regulators (LDO1 and LDO2) can generate two independently regulated power supplies (Vreg1 and Vreg2), and the two loops responsible for generating both regulated power supplies may have independent loop bandwidths. In accordance with embodiments of the invention, LDO1 provides a first regulated output (Vreg1) to a bandgap voltage reference circuit in the reference voltage generation block (41) to generate a reliable voltage reference during operations, and the LDO2 provides a regulated output (Vreg2) to support a load.

The voltage reference generation block (41) initially uses system power (VDD) to generate a voltage reference. After startup, the voltage reference generation block (41) may use Vreg1 from LDO1 to generate a voltage reference. Details about how the voltage reference generation block (41), which includes the bandgap voltage reference circuit (41*a*), the selector (41*b*), and the control block (41*c*), may be implemented and how the control functions will become apparent from the following examples.

Figure 4B:
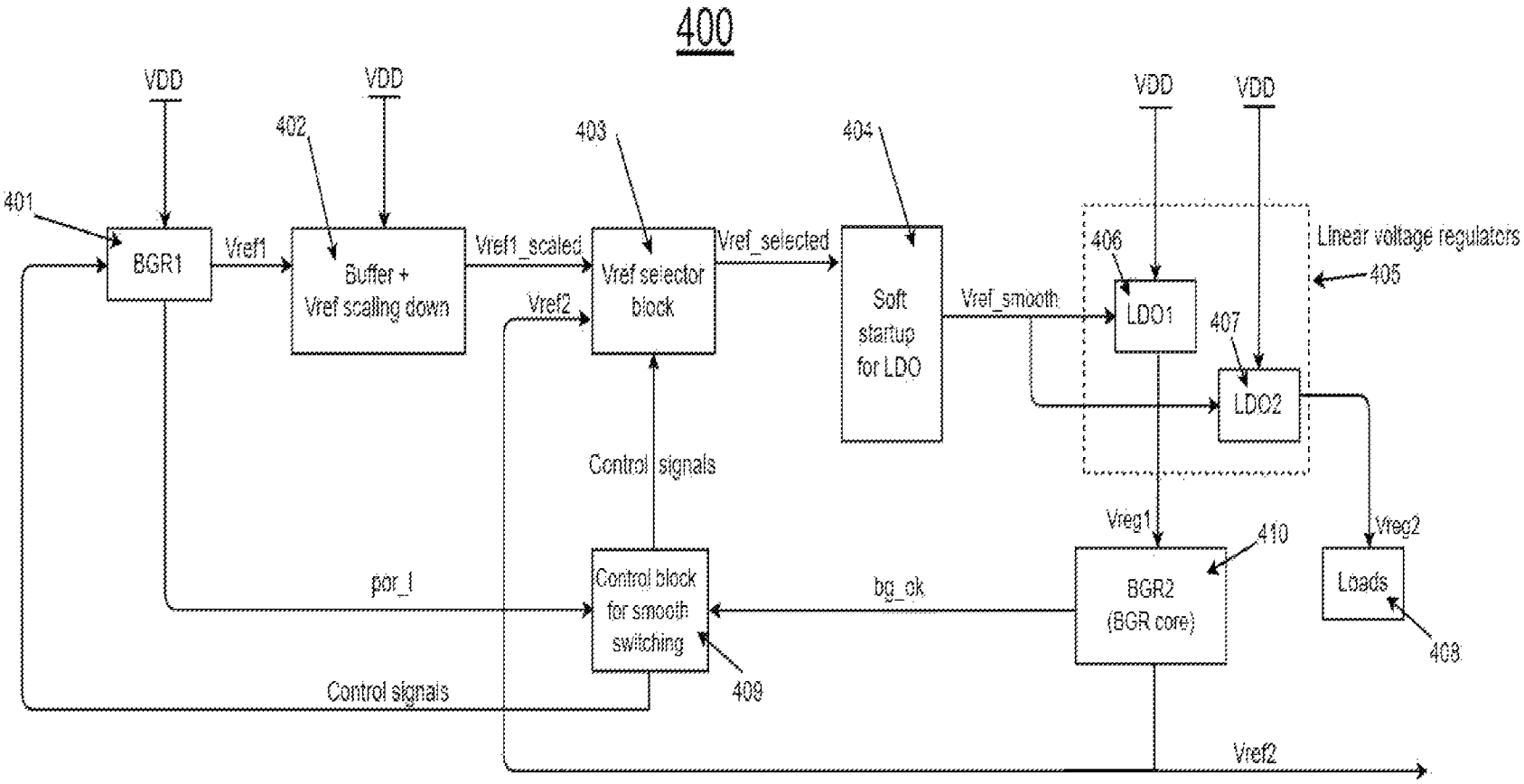
FIG. 4B shows a block level circuit diagram of a regulation loop in accordance with one embodiment of the invention. This regulation loop includes two bandgap voltage reference (BGR) circuits, two linear voltage regulators (LDOs), a Vref selector block, a soft startup for the LDOs, and a control block.

As noted above, the voltage reference generation block (41) in accordance with embodiments of the invention may include one or two bandgap voltage reference circuits. FIG. 4B shows a block level circuit diagram of an exemplary voltage regulation loop (400) in accordance with one embodiment of the invention. In this example, the voltage regulation loop (400) includes two bandgap voltage reference circuits: the first bandgap voltage reference circuit (BGR1, 401) generates a first voltage reference (Vref1) and the second bandgap voltage reference circuit (BGR2, 410) generates a second voltage reference (Vref2). Vref1 and Vref2 can have independent values (degree of freedom), which may be identical or different, because they are independently powered from different supplies. The first bandgap voltage reference circuit BGR1 (401) is powered by VDD, while the second bandgap voltage reference circuit BGR2 (410) is powered by the first regulated voltage (Vreg1) from the first linear voltage regulator (LDO1). The Vref1 can be used to detect a startup threshold of the system supply. BGR1 may also generate a power on reset signal and also starts up the linear voltage regulators block (405).

The voltage regulation loop (400) includes a linear voltage regulator block (405) that has two linear voltage regulators: a first linear voltage regulator LDO1 (406) and a second linear voltage regulator LDO2 (407). The first linear voltage regulator LDO1 (406) generates a first regulated voltage (Vreg1), which is a power supply for the second bandgap voltage reference circuit BGR2 (410), while the second linear voltage regulator LDO2 (407) generates a second regulated voltage (Vreg2), which is a supply for the other loads (408) in the system.

In accordance with embodiments of the invention, the first voltage reference (Vref1) may be scaled (e.g., using a voltage divider) to generate a scaled first voltage reference (Vref1_scaled), which is equal to the second voltage reference (Vref2). While the first voltage reference (Vref1) is being scaled, a compensatory mechanism may be used to ensure that the linear voltage regulators block (405) maintains constant operations.

The voltage regulation loop (400) includes a buffer and Vref scaling block (402) that takes Vref1 and scales it to Vref1_scaled, such that Vref1_scaled and Vref2 have the same value. The voltage regulation loop (400) also includes a voltage reference selector block (Vref selector block) (403), which is responsible for selecting a voltage reference (Vref_selected) that will be used by the soft startup for LDO (404) to generate a smoothed voltage reference (Vref_smooth) for the voltage regulators block (405). The Vref selector block (403) switches the voltage reference from Vref1_scaled to Vref2, when Vref2 is ready. One exemplary switching scheme is shown in FIG. 6.

The voltage regulation loop (400) also includes a soft startup circuit (404) for the linear voltage regulators (LDO1 and LDO2). The soft startup circuit (404) takes the selected voltage reference (Vref_selected) coming from the voltage reference selector block (403) and smooths it to generate Vref_smooth that goes to the linear voltage regulators LDO1 (406) and LDO2 (407) to avoid any overshoots at the output of regulators during start-up. The voltage regulation loop (400) also includes a control block (409), which generates one or more control signals used during switching and guarantees the smooth switching between different voltage references in the voltage reference selector block (403). During normal operations, the first bandgap voltage reference circuit BGR1 (401) may be optionally turned off after the switching is done to save system quiescent power.

Figure 5:
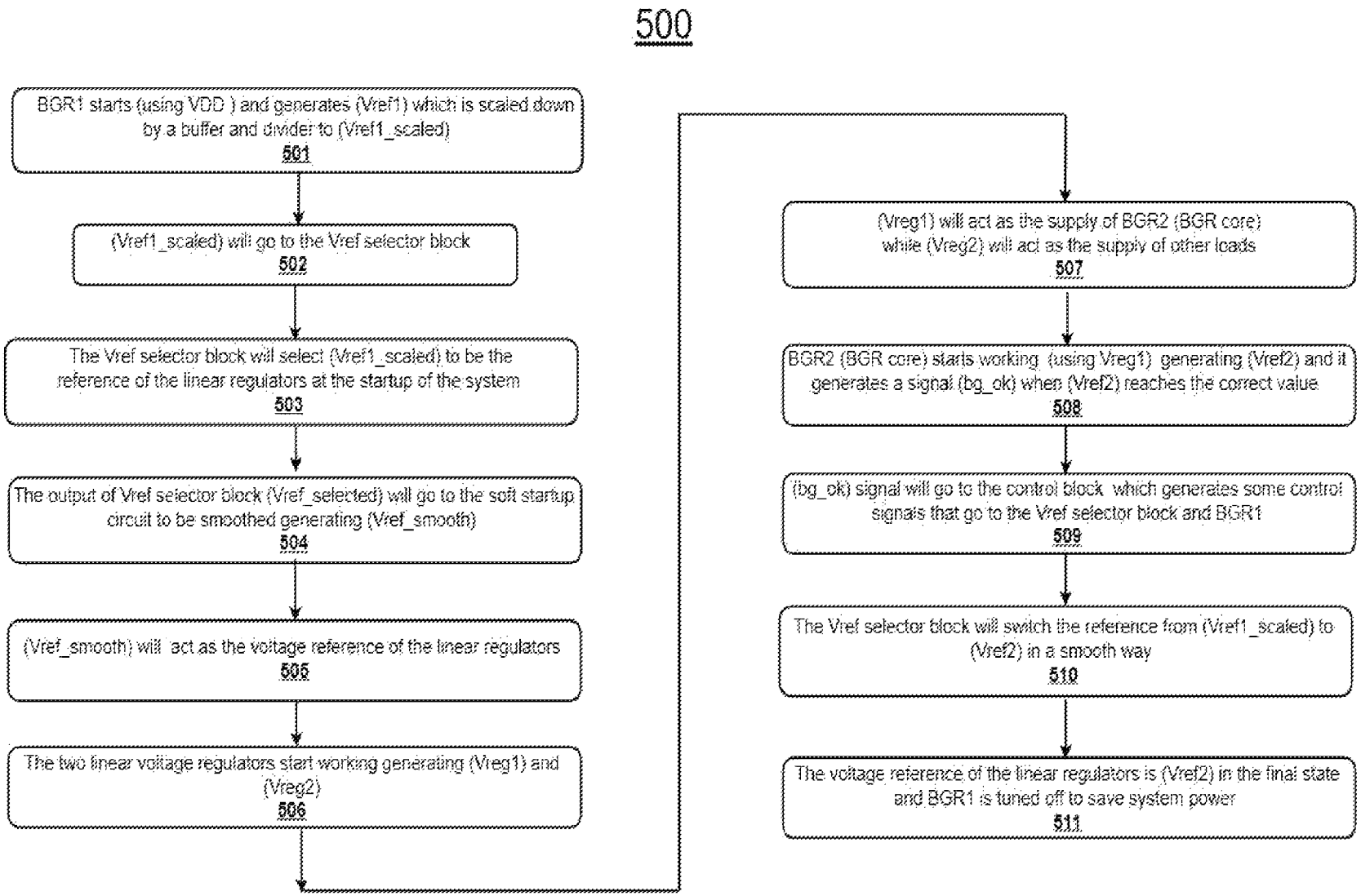
FIG. 5 shows a flow chart that illustrates an operation of the regulation loop of FIG. 4B.

FIG. 5 shows a flowchart (500) that illustrates an example of the operation of the voltage regulation loop (400) in FIG. 4B. When the system powers-up, the first bandgap voltage reference circuit BGR1 starts working (using VDD as the power supply) and generates Vref1, which is scaled down by a buffer and divider to Vref1_scaled (step 501). Then, this scaled voltage reference Vref1_scaled goes to the voltage reference selector block (step 502). The voltage reference selector block will select Vref1_scaled during the system power-up (step 503). This selected voltage reference (Vref_selected) will go to the soft startup circuit to be smoothed to generate Vref_smooth (step 504). The smooth voltage reference (Vref_smooth) will act as the voltage reference of the linear voltage regulators (step 505). Then, the two linear voltage regulators (LDO1 and LDO2) start working (using VDD as the power supply) generating Vreg1 and Vreg2 (step 506). Vreg1 will act as the power supply for the second bandgap voltage reference circuit BGR2 (BGR core), while Vreg2 will act as the power supply for the other loads (step 507). Then, the second bandgap voltage reference circuit BGR2 (BGR core) starts working (using Vreg1 as its power supply) to generate Vref2 as well as an alert signal (bg_ok) when Vref2 reaches the correct (pre-determined) value (step 508). The signal bg_ok will go to the control block, which generates some control signals that may go to both the voltage reference selector block and the first bandgap voltage reference circuit BGR1 (step 509). According to these control signals, the voltage reference selector block will switch the voltage reference from Vref1_scaled to Vref2 in a smooth manner (step 510) and the first bandgap voltage reference circuit BGR1 may be optionally turned off to save system quiescent power (step 511).

Figure 6:
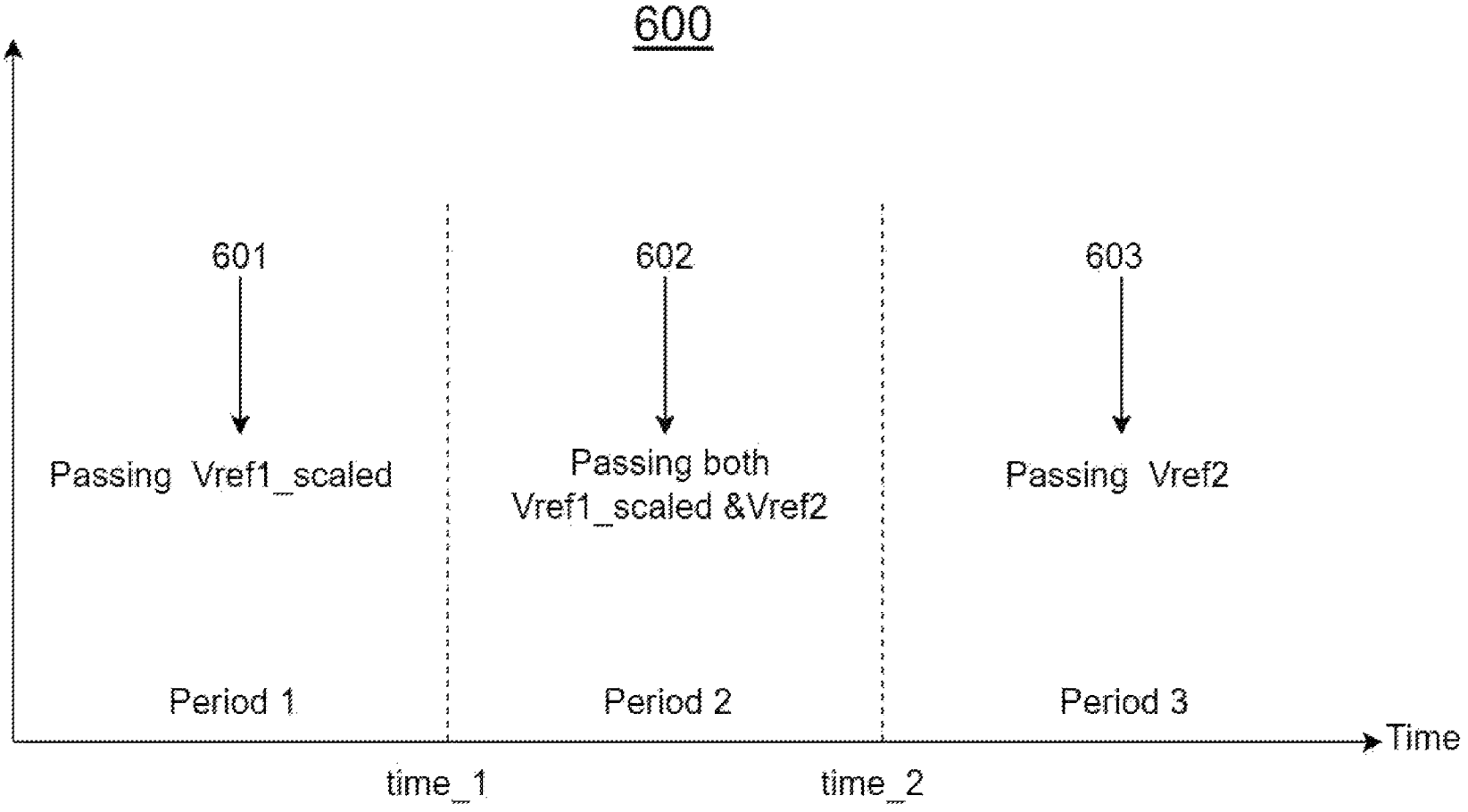
FIG. 6 shows a timeline indicating how the switching of a voltage reference may be carried out in a Vref selector block that can be used in the regulation loop of FIG. 4B.

FIG. 6 shows a timeline (600) indicating how the switching of the voltage references may be carried out in the voltage reference selector block (403) in a smooth manner. During the first period (601), the voltage reference selector block passes the Vref1_scaled to its output. During the second period (602), the voltage reference selector block passes both Vref1_scaled and Vref2 to its output (passing both of them, because they have the same value). During the third period (603), the voltage reference selector block passes Vref2 to its output. The timeline (600) ensures that the switching is carried out with no drop in the output of the voltage reference selector block. The control block (409) may be used to generate all control signals required to implement the timeline (600) shown in FIG. 6.

Figure 7:
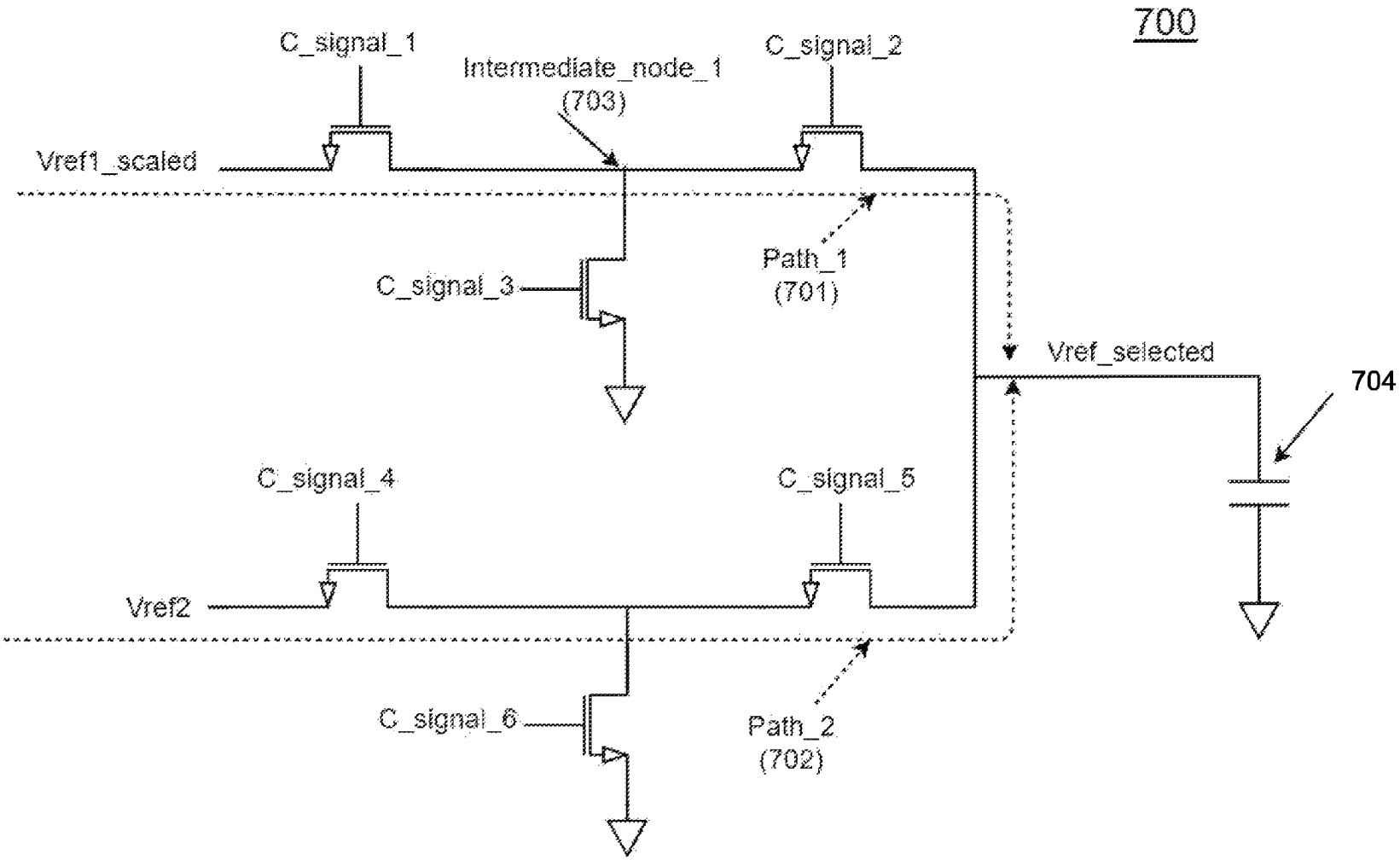
FIG. 7 shows an example circuit diagram of a Vref selector block that can be used in the regulation loop of FIG. 4B.

To accomplish the above-mentioned voltage reference selection, any suitable implementation may be used for the voltage reference selector block (403). FIG. 7 shows an example of a schematic block level circuit diagram (700) that may be used to implement the voltage reference selector block (403). In this example, there are two paths (switching paths) from the input to the output. The first one is Path_1 (701), which is dedicated for Vref1_scaled. The second one is Path_2 (702), which is dedicated for Vref2. In this example, there are 6 control signals to control the switching. All these control signals may come from the control block (409) and they are used to do the smooth transition of Vref_selected. After the switching to Vref2 is done, Path_1 may be turned off, and the intermediate_node_1 (703) may be pulled down to ground for more isolation. There is also a capacitor (704) at the output of the voltage reference selector block to hold the value of the Vref_selected during the switching time, so that any drop in the selected voltage reference going to the voltage regulators can be avoided. In addition, this capacitor (704) enhances the PSR of the selected voltage reference.

Figure 8:
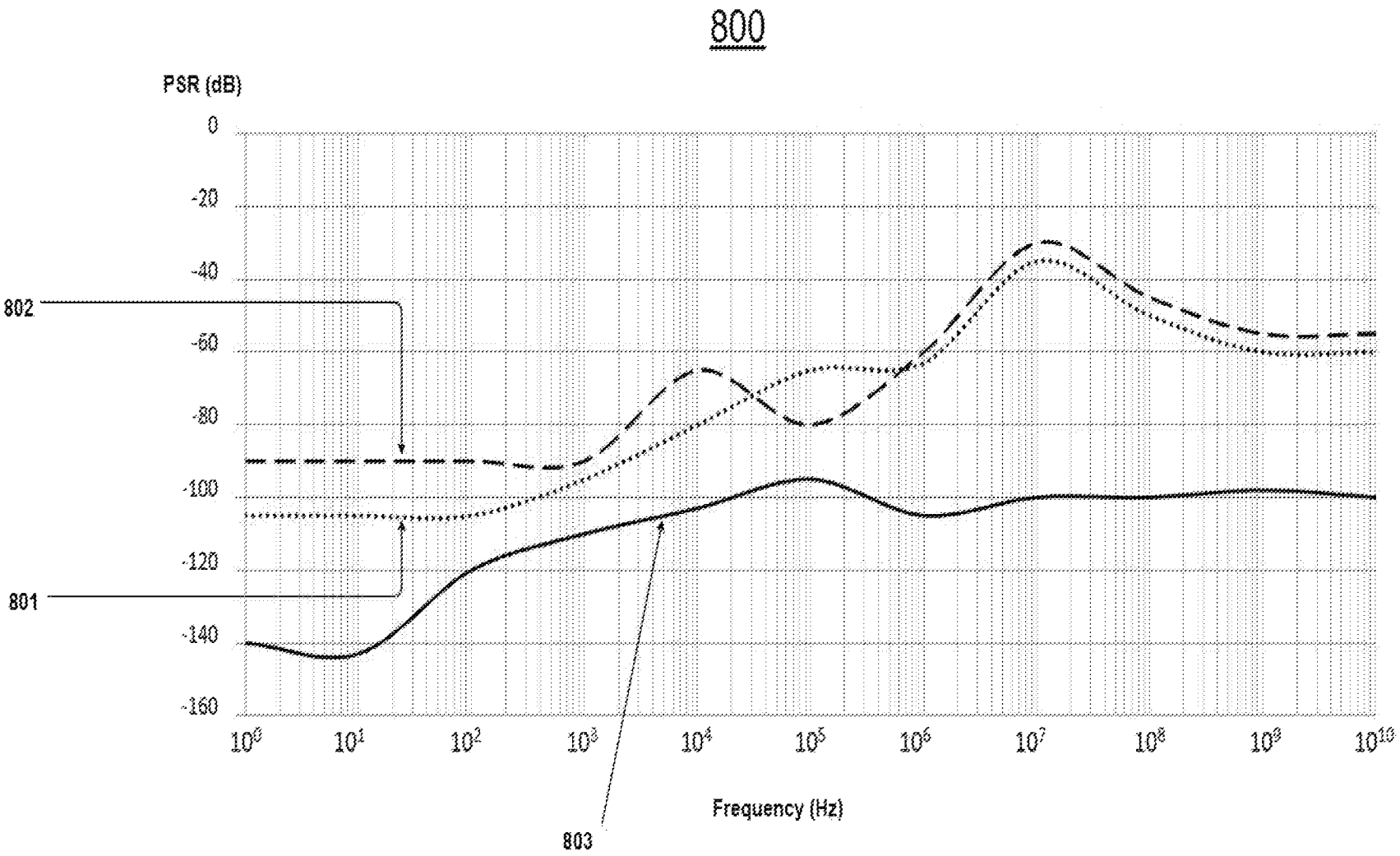
FIG. 8 shows the simulated PSR curves of the regulation loop of FIG. 4B.

Embodiments of the invention can provide high power supply rejections (PSR), while maintaining stable operations. FIG. 8 shows the simulated PSR curves (800) of the voltage regulation loop (400) of FIG. 4B. Curve (801) shows the simulated PSR of Vreg1. Curve (802) shows the simulated PSR of Vreg2. Curve (803) shows the simulated PSR of Vref2. The voltage regulation loop (400) of FIG. 4B can achieve very high PSR for the second voltage reference and the voltage regulators outputs (regulated supply domains). The PSR of the second voltage reference (Vref2) is up to 95 dB till 10 GHz. The PSR of the voltage regulators outputs (Vreg1 and Vreg2) is up to 60 dB till 1 MHz and up to 30 dB till 10 GHz.

Figure 9:
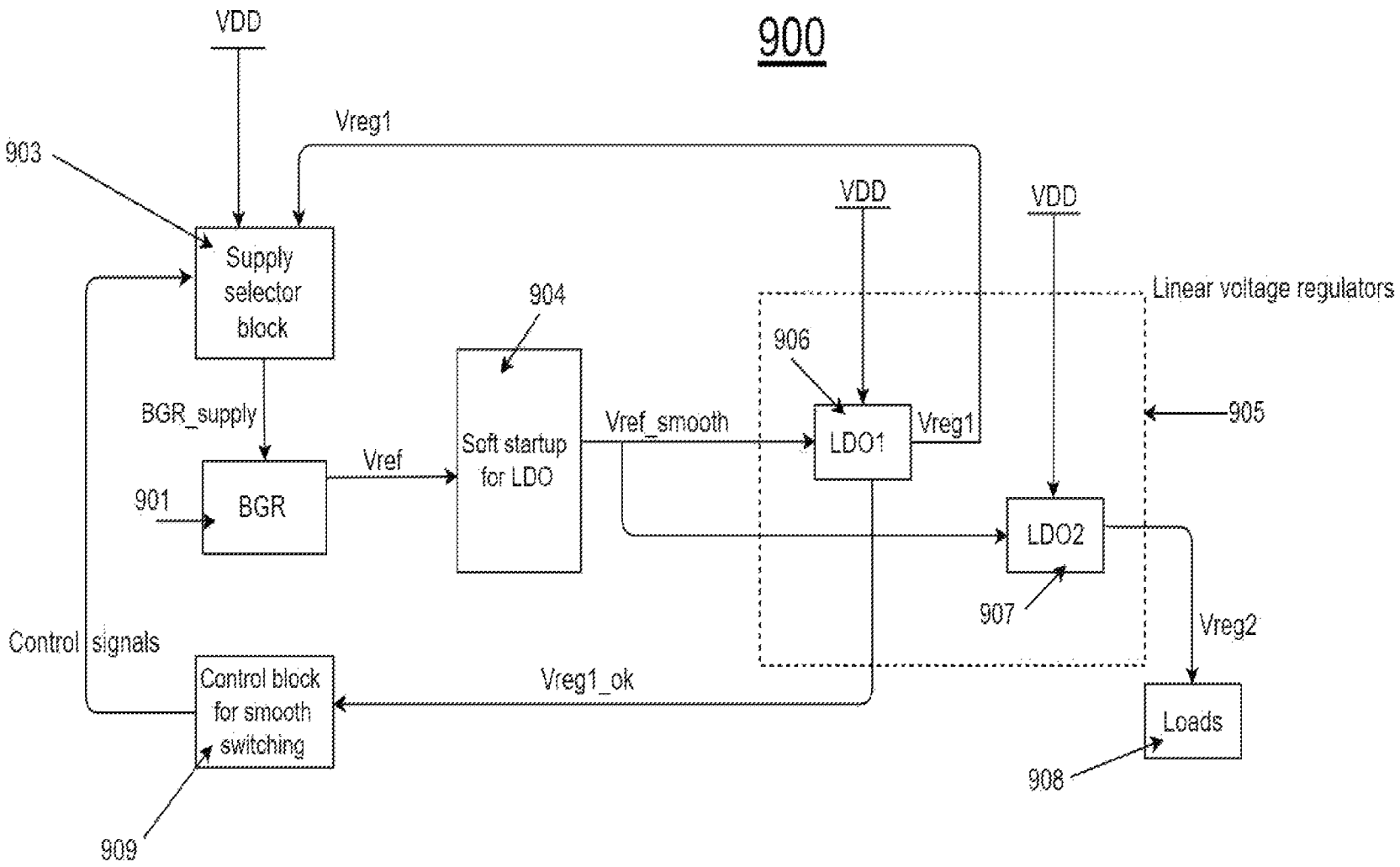
FIG. 9 shows a block level circuit diagram of a regulation loop in accordance with another embodiment of the invention. This regulation loop includes one bandgap voltage reference circuit (BGR), two linear voltage regulators (LDOs), a supply selector block, a soft startup for the LDOs, and a control block.

While FIG. 4B shows an example having two bandgap voltage reference circuits, other embodiments of the invention may use only one bandgap voltage reference circuit. For example, FIG. 9 shows a block level circuit diagram of a voltage regulation loop (900) in accordance with another embodiment of the invention. The voltage regulation loop (900) includes one bandgap voltage reference circuit BGR (901), the power supply of which (BGR_supply) comes from the output of a supply selector block (903). The voltage regulation loop (900) also includes a linear voltage regulator block (905) that comprises two linear voltage regulators (LDO1 and LDO2). The first voltage regulator LDO1 (906) generates Vreg1, which can function as a power supply for the bandgap voltage reference circuit BGR (901). The second voltage regulator LDO2 (907) generates Vreg2, which is the power supply of the other loads (908) in the system. Both Vreg1 and Vreg2 can have independent values, which may be identical or different.

The supply selector block (903) can takes either VDD or Vreg1 as a power source for the bandgap voltage reference circuit BGR (901). The supply selector block (903) selects the correct source for power supply (BGR_supply) for the bandgap voltage reference circuit BGR (901). There is also a control block (909), which is responsible for generating the control signals used in switching the power supply in a smooth way. The system also includes a soft startup block (904) for the regulators, which smooths the voltage reference generated by the bandgap voltage reference circuit (Vref) to generate Vref_smooth that will be used by the linear voltage regulators (LDO1 and LDO2) to avoid any overshoots in the output of regulator during power-up.

Figure 10:
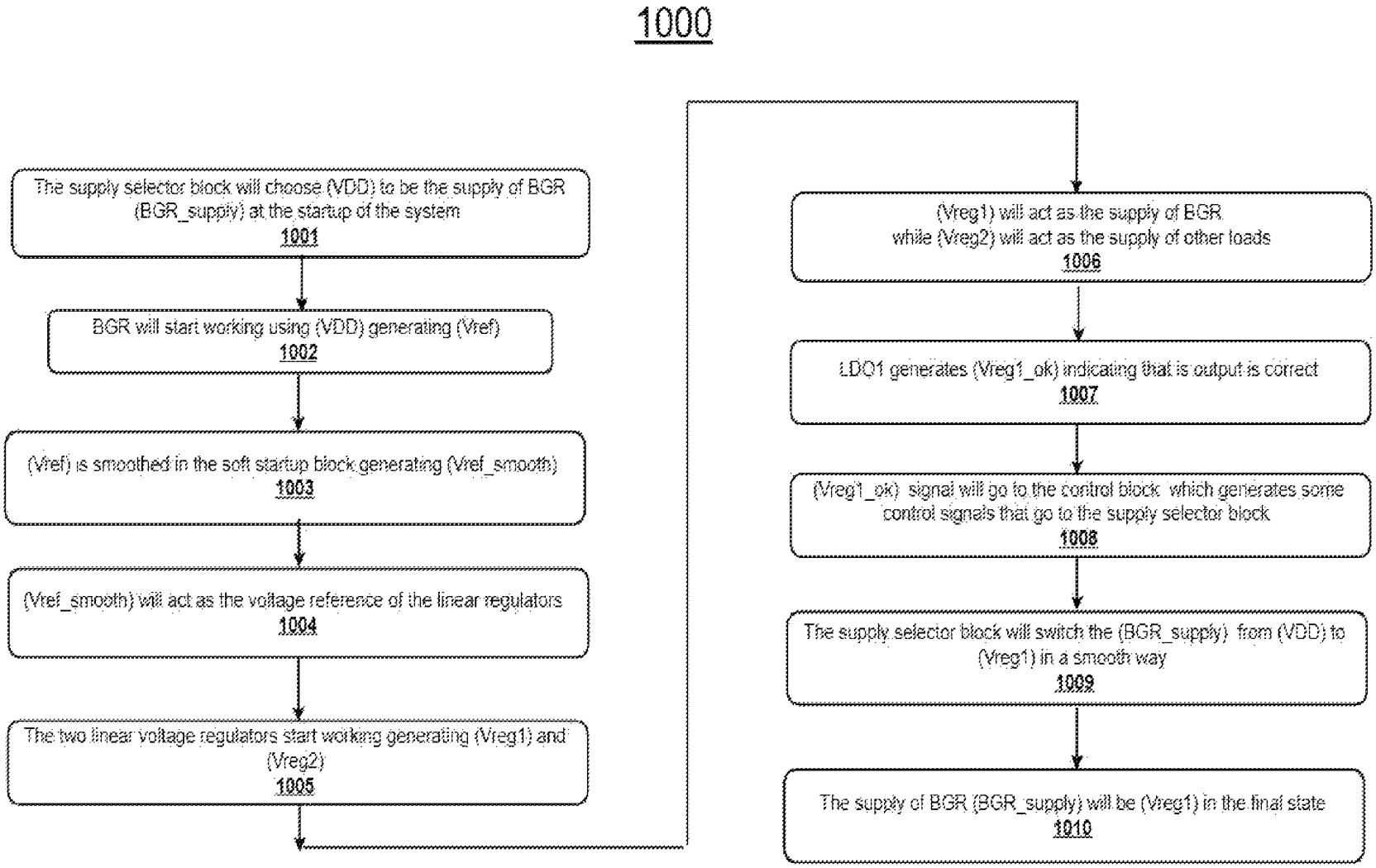
FIG. 10 shows a flow chart that illustrates an operation of the regulation loop of FIG. 9.

FIG. 10 shows a flow chart (1000) that illustrates an example of the operation of the voltage regulation loop (900) of FIG. 9. At the start of the system, the supply selector block will choose VDD to be the power supply of the bandgap voltage reference circuit BGR (step 1001). The bandgap voltage reference circuit BGR starts working using VDD and generates Vref (step 1002). The generated voltage reference Vref goes to the soft startup circuit to be smoothed to generate Vref_smooth (step 1003). The smooth voltage reference Vref_smooth will act as the voltage reference of the linear voltage regulators (step 1004). The two linear voltage regulators (LDO1 and LDO2) receive the system power supply VDD and Vref_smooth to generate two independent, regulated power supply domains Vreg1 and Vreg2 (step 1005). Vreg1 is dedicated for the bandgap voltage reference circuit BGR, while Vreg2 is dedicated for other loads (step 1006). The first voltage regulator LDO1 may also generate a Vreg1_ok signal, indicating that its output voltage is correct (step 1007). The signal Vreg1_ok goes to the control block to generate some control signals that go to the supply selector block (step 1008). The supply selector block switches the source for the supply of the bandgap voltage reference circuit BGR from VDD to Vreg1 once receiving these control signals from the control block (step 1009). The switching of the source of the supply of the bandgap voltage reference BGR is done in a smooth way without any drop, due to the control block responsible for generating the control signals in certain order to be used in this switching. The final state is that the source of the supply of the bandgap voltage reference circuit BGR (BGR_supply) is Vreg1 (step 1010).

Figure 11:
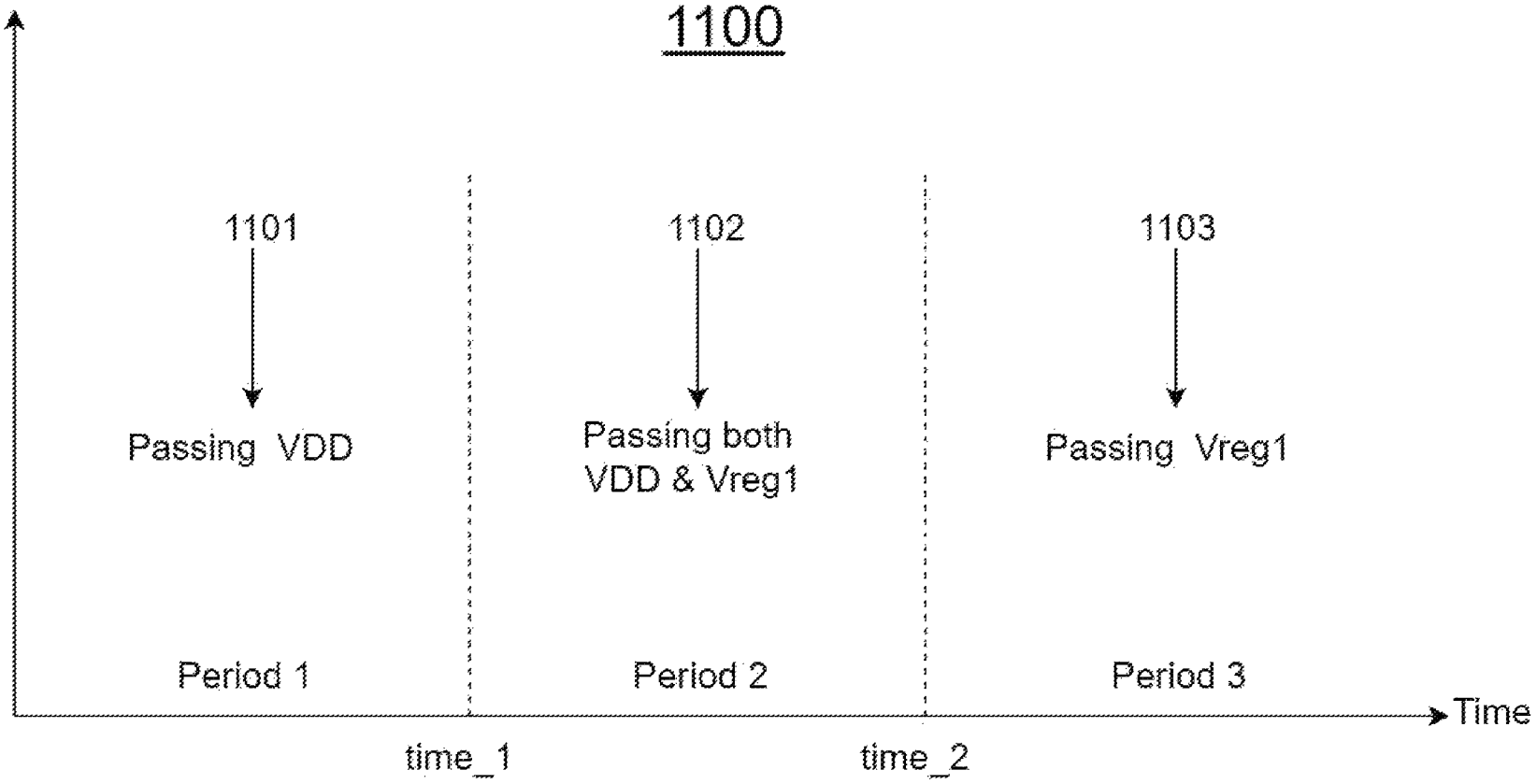
FIG. 11 shows a timeline indicating how the switching of a supply may be carried out in a supply selector block that can be used in the regulation loop of FIG. 9.

FIG. 11 shows a timeline (1100) indicating how the switching of the supply may be done in the power supply selector block (903 in FIG. 9) in a smooth manner without a risk. During the first period (1101), the power supply selector block passes the VDD to its output. In the second period (1102), the supply selector block passes both VDD and Vreg1 to its output (for a very short time). In the third period (1103), the supply selector block passes Vreg1 to its output. The timing diagram (1100) in FIG. 11 ensures that the switching is done with no drop in the output of the supply selector block (BGR_supply). The control block (909 in FIG. 9) may generate all the control signals required to implement the timeline (1100) of FIG. 11.

Figure 12:
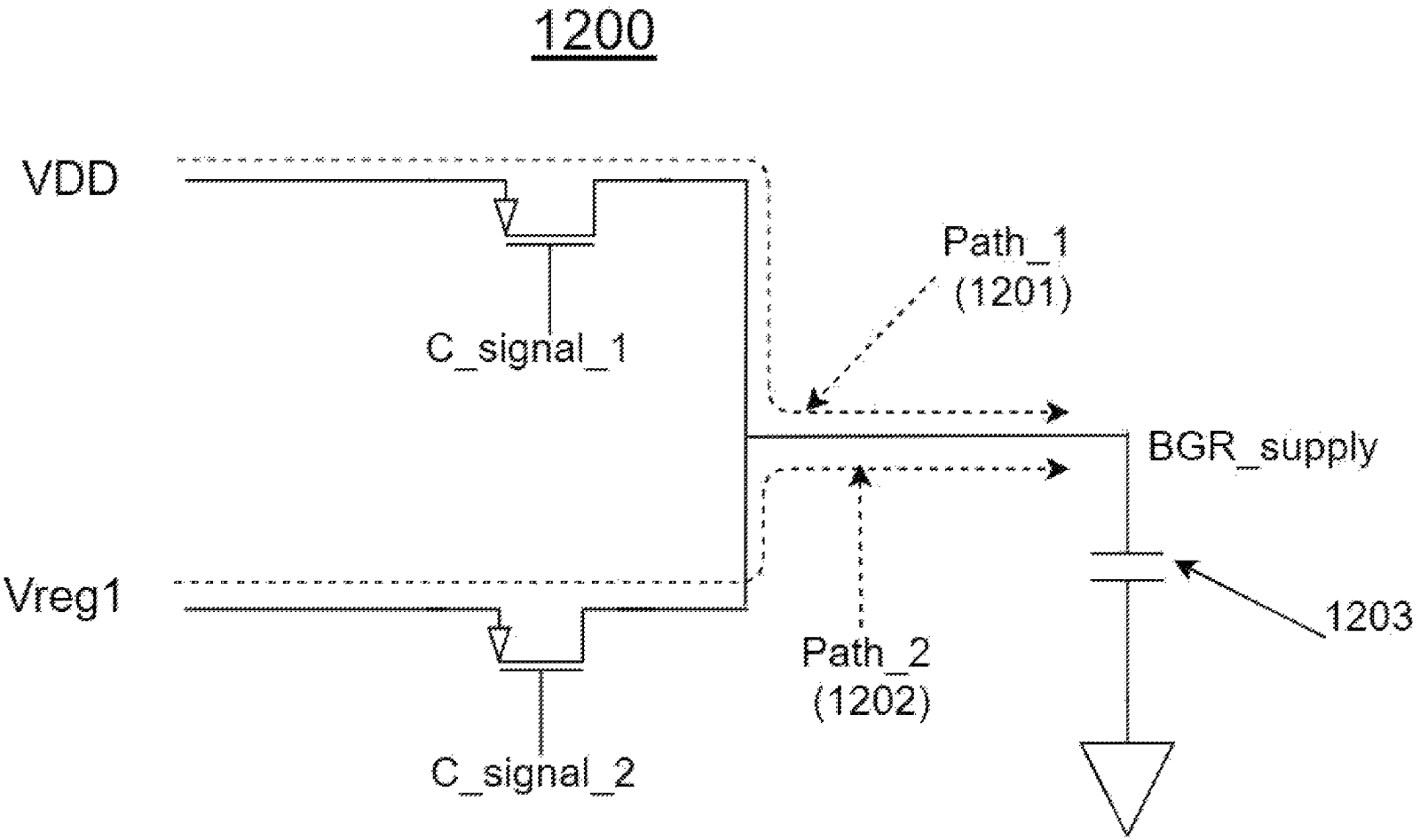
FIG. 12 shows an example circuit diagram of a supply selector block that can be used in the regulation loop of FIG. 9.

The power supply selector (or simply "supply selector") block in FIG. 9 may be implemented in any suitable manner. FIG. 12 shows an example for a schematic block level circuit diagram (1200) of a power supply selector block. In this example, the power supply selector block has two paths from the input to the output. The first one is Path_1 (1201) that is dedicated for passing VDD and the second one is Path_2 (1202) that is dedicated for passing Vreg1. There are two control signals in the schematic to control the switching. All these control signals may come from the control block (909 in FIG. 9) and they are used to do the smooth switching of the BGR_supply. There is also a capacitor (1203) at the output of the supply selector block to hold the value of BGR_supply during the switching time, so that any drop in the supply going to the voltage reference circuit BGR can be avoided.

Figure 13:
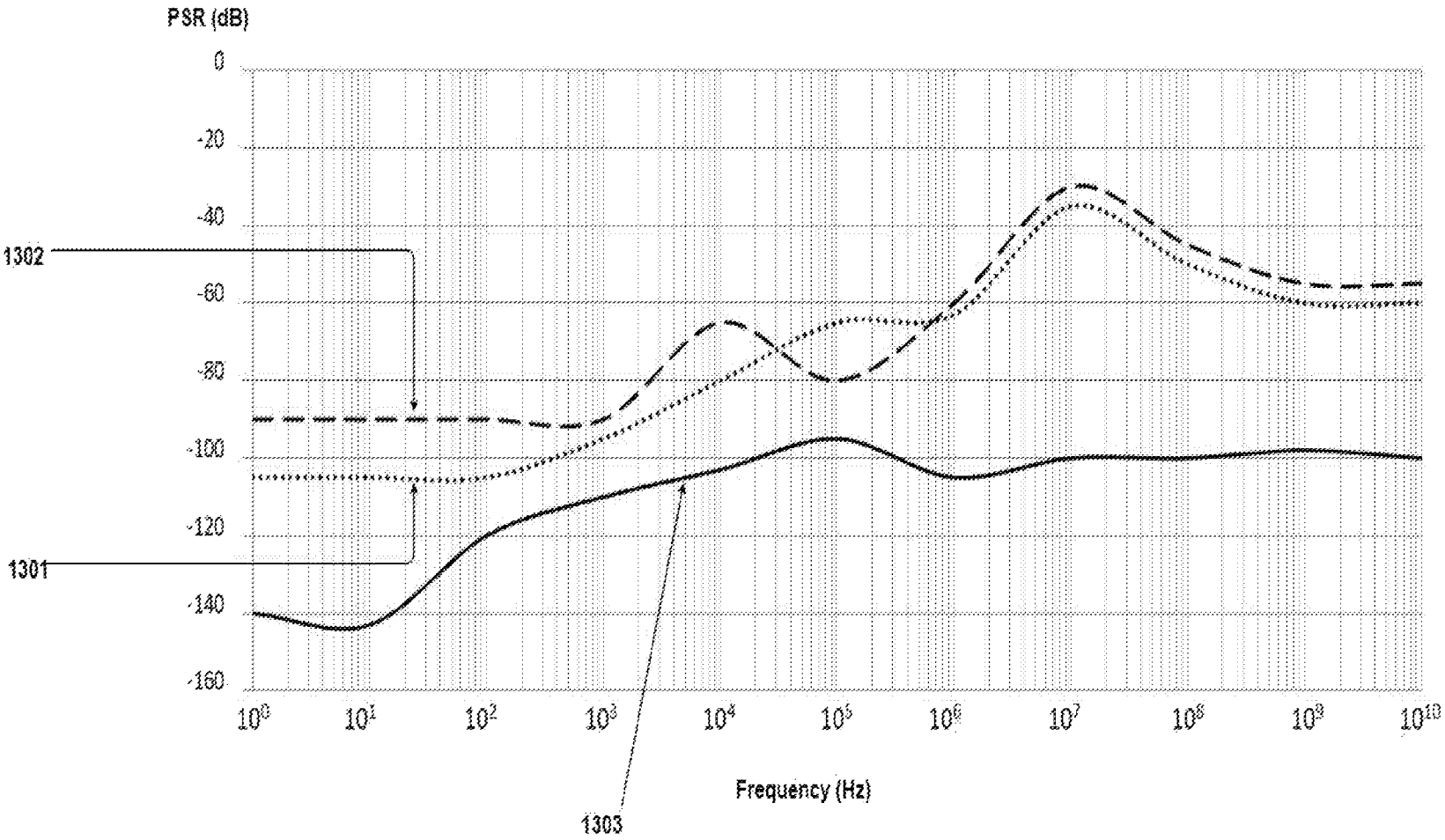
FIG. 13 shows the simulated PSR curves of the regulation loop of FIG. 9.
Figure 14:
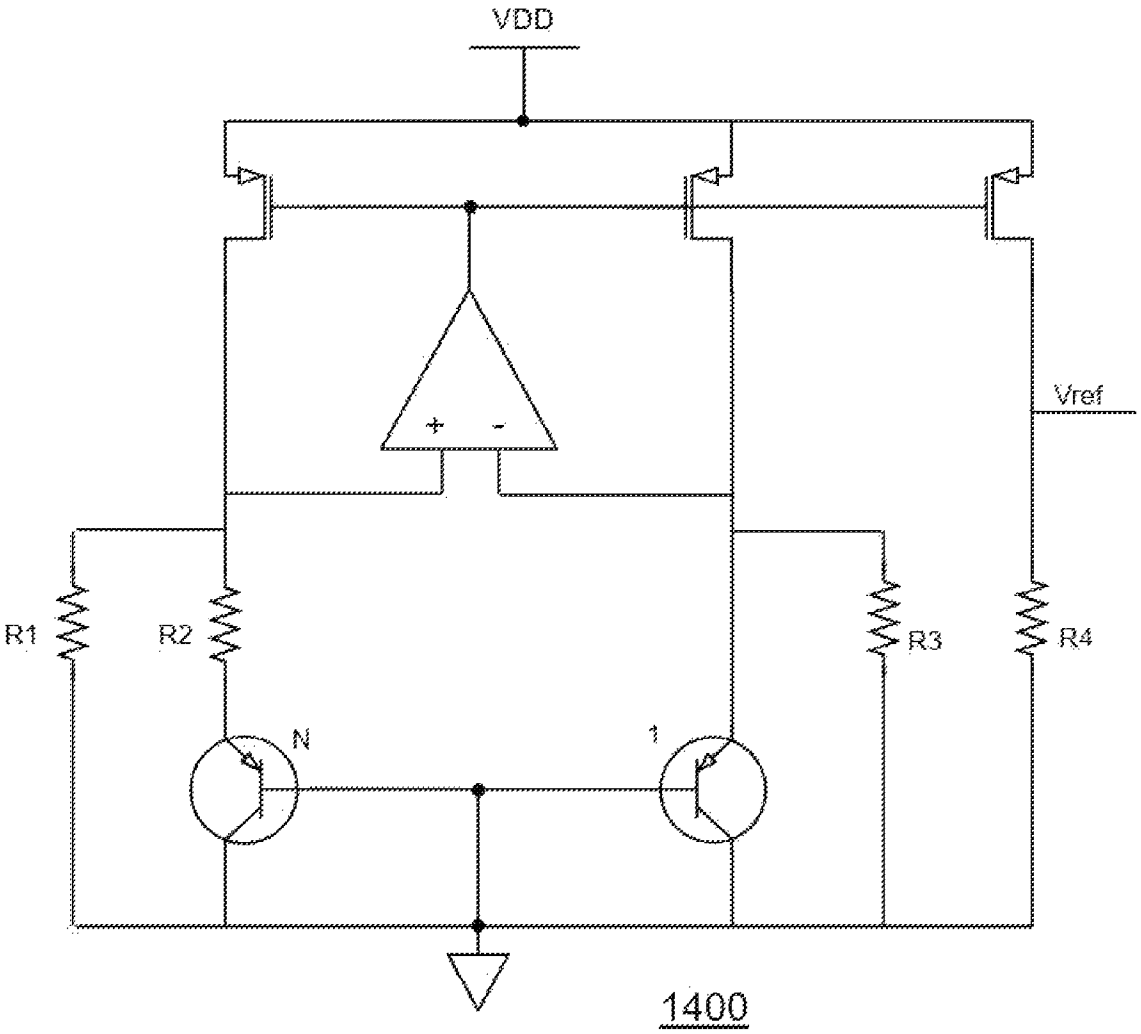
FIG. 14 shows an example circuit diagram of a bandgap voltage reference circuit that can be used in a regulation loop of the invention, such as those shown in FIG. 4A, FIG. 4B, and FIG. 9.

FIG. 13 shows the simulated PSR curves (1300) of the voltage regulation loop (900) of FIG. 9. Curve (1301) shows the simulated PSR of Vreg1. Curve (1302) shows the simulated PSR of Vreg2. Curve (1303) shows the simulated PSR of Vref. The voltage regulation loop (900) of FIG. 9 can achieve very high PSR for the voltage reference and the voltage regulators outputs (regulated supply domains). The PSR of the voltage reference Vref is up to 95 dB till 10 GHz. The PSR of the voltage regulators outputs (Vreg1 and Vreg2) is up to 60 dB till 1 MHz and up to 30 dB till 10 GHz As shown above, embodiments of the invention may use one or more bandgap voltage reference circuits. Any suitable bandgap voltage reference circuits may be used with embodiments of the invention. FIG. 14 shows an example for a schematic block level circuit diagram of a bandgap voltage reference circuit (1400) that can be used in the regulation loops of the invention, such as those shown in FIG. 4A, FIG. 4B, and FIG. 9. The schematic shows a fractional bandgap topology. One skilled in the art would appreciate that other topologies may also be used.

Advantages of embodiments of the invention may include one or more of the following. In accordance with embodiments of the invention, the first regulated power supply (Vreg1) provided by the first voltage regulator (LDO1) is used to power the bandgap voltage reference circuit, while the second regulated power supply (Vref2) provided by the second voltage regulator (LDO2) is used as the supply for the other loads. Therefore, variations in the loads will not impact the stability of Vreg1, which in turn ensures stability of the voltage reference. In the final state (during normal operation) of the system, the second voltage reference (Vref2) may be provided by a bandgap voltage reference circuit that is powered by a regulated voltage (Vreg1) from LDO1, and the system power supply (VDD) to a bandgap voltage reference circuit may be turned off to save power. Embodiments of the invention include soft startup circuits to ensure that linear voltage regulators (LDO1 and LDO2) will not over-shoot at the startup. A system of the invention can achieve excellent PSR on the order of several decades in dBs up to ultra-high frequencies of a few GHz for the voltage reference and the voltage regulators outputs (regulated supply domains).

While the invention has been described with respect to a limited number of embodiments, those skilled in the art, having the benefit of this disclosure, will appreciate that other embodiments can be devised which do not depart from the scope of the invention as disclosed herein. Accordingly, the scope of the invention should be limited only by the attached claims.

What is claimed is:

1. A voltage regulation loop, comprising:

a voltage reference generation block comprising at least one bandgap voltage reference circuit, a selector, and a control block;

a linear voltage regulator block that comprises a first linear voltage regulator and a second linear voltage regulator, wherein an output of the first linear voltage regulator is not connected with an output of the second linear voltage regulator such that the first linear voltage regulator and the second linear voltage regulator are configured to function independently, wherein the first linear voltage regulator provides a first regulated power supply to the at least one bandgap voltage reference circuit in the voltage reference generation block, and the second linear voltage regulator provides a second regulated power supply to a load, wherein the two linear voltage regulators are configured to be on at the same time and each one supports a different load; and a soft startup circuit connected between the voltage reference generation block and the linear voltage regulator block, wherein the at least one bandgap voltage reference circuit generates at least one voltage reference, and the selector functions with the control block to output a selected voltage reference to pass to the soft startup circuit, wherein the soft startup circuit smooths the selected voltage reference and produces a smoothed voltage reference to pass to the linear voltage regulator block to prevent overshoots at startup, and wherein the first linear voltage regulator is part of a startup loop that comprises the soft startup circuit, while the second linear voltage regulator is not part of the startup loop.

2. The voltage regulation loop according to claim 1, wherein each of the first linear voltage regulator and the second linear voltage regulator comprises one or more error amplifiers and a pass transistor; and wherein the pass transistor is an NMOS transistor, a PMOS transistor, a PNP transistor, an NPN transistor, or a FinFET device.

3. The voltage regulation loop according to claim 1, further comprising a voltage buffer and voltage scaling circuit, wherein the at least one bandgap voltage reference circuit comprises a first bandgap voltage reference circuit that generates a first voltage reference and a second bandgap voltage reference circuit that generates a second voltage reference, wherein the first voltage reference and the second voltage reference have independent values, wherein the first bandgap voltage reference circuit is powered from a system power supply to generate the first voltage reference that is used to detect a startup threshold of the system supply and to start up the linear voltage regulator block;

wherein the second bandgap voltage reference circuit takes the first regulated power supply from the first linear voltage regulator to generate the second voltage reference and a control signal that indicates that the second voltage reference has reached a predetermined value;

wherein the voltage buffer and voltage scaling circuit takes the first voltage reference and scales it to a scaled first voltage reference, such that the scaled first voltage reference is equal to the second voltage reference;

wherein the selector is a voltage reference selector that takes the scaled first voltage reference, the second voltage reference, and the control signal as inputs to select the selected voltage reference to pass to the soft startup circuit.

4. The voltage regulation loop according to claim 3, wherein each of the first linear voltage regulator and the second linear voltage regulator comprises one or more error amplifiers and a pass transistor; and wherein the pass transistor is an NMOS transistor, a PMOS transistor, a PNP transistor, an NPN transistor, or a FinFET device.

5. The voltage regulation loop according to claim 3,
wherein the voltage buffer comprises a voltage divider, and
wherein the first voltage reference is scaled using the voltage divider to generate the scaled first voltage reference.

6. The voltage regulation loop according to claim 3,
wherein the voltage reference selector includes one or more switches and a capacitor to hold a value of the selected voltage reference to avoid any drop during a switching time and to enhance a PSR of the selected voltage reference, and
wherein the voltage reference selector selects a correct voltage reference by starting with the scaled first voltage reference and then switching over to the second voltage reference once its value reaches a predetermined value.

7. The voltage regulation loop according to claim 3,
wherein the control block is responsible for smooth switching of the selected voltage reference by generating a plurality of control signals in a predetermined order to control the voltage reference selector in a sequence of switching between different voltage references without causing any drop in the selected voltage reference.

8. The voltage regulation loop according to claim 3,
wherein the first bandgap voltage reference circuit is turned off to save system quiescent power after the second bandgap voltage reference circuit is working properly.

9. The voltage regulation loop according to claim 1:
wherein the at least one bandgap voltage reference circuit has one bandgap voltage reference circuit,
wherein the selector is a power supply selector that selects a power supply for the one bandgap voltage reference circuit,
wherein the power supply selector selects a system power supply for the one bandgap voltage reference circuit at startup, and then when the first linear voltage regulator and the second linear voltage regulator are stable, it selects the first regulated power supply for the one bandgap voltage reference circuit,
wherein the control block generates a control signal when the first linear voltage regulator is working properly, wherein the control signal is used in switching the power supply for the one bandgap voltage reference circuit to ensure smooth switching from the system power supply to the first regulated power supply.

10. The voltage regulation loop according to claim 9,
wherein each of the first linear voltage regulator and the second linear voltage regulator comprises one or more error amplifiers and a pass transistor; and
wherein the pass transistor is an NMOS transistor, a PMOS transistor, a PNP transistor, an NPN transistor, or a FinFET device.

11. The voltage regulation loop according to claim 9,
wherein the power supply selector includes switches and a capacitor at its output to hold a value of a selected power supply to avoid any drop during switching, wherein the capacitor enhances a power supply rejection of the selected power supply going to the one bandgap voltage reference circuit; and
wherein the power supply selector is used to select a correct source as the power supply for the one bandgap voltage reference circuit by starting with the system power supply, and then switching over to the first regulated power supply once its voltage is correct.

12. The voltage regulation loop according to claim 9,
wherein the control block is responsible for smooth switching of the power supply for the one bandgap voltage reference circuit by generating a plurality of control signals in a predetermined order that go to the power supply selector to manage the switching between different supplies smoothly without causing any voltage drop.

13. The voltage regulation loop according to claim 9,
wherein the soft startup circuit takes a voltage reference generated by the bandgap voltage reference circuit and produces a smooth voltage reference that goes to the first linear voltage regulator and the second linear voltage regulators-to have a smooth start with no overshoots.

14. A method for voltage regulation in a system using a voltage regulation loop that comprises: a voltage reference generation block comprising at least one bandgap voltage reference circuit, a selector, and a control block; a linear voltage regulator block that comprises a first linear voltage regulator and a second linear voltage regulator, wherein an output of the first linear voltage regulator is not connected with an output of the second linear voltage regulator such that the first linear voltage regulator and the second linear voltage regulator are configured to function independently, wherein the first linear voltage regulator provides a first regulated power supply to the at least one bandgap voltage reference circuit in the voltage reference generation block, and the second linear voltage regulator provides a second regulated power supply to a load; and a soft startup circuit connected between the voltage reference generation block and the linear voltage regulator block, the method comprising:
providing a system power supply to the at least one bandgap voltage reference circuit in the voltage reference generation block to generate a voltage reference to the soft startup circuit, which then outputs a smooth voltage reference to the linear voltage regulator block to start up the first linear voltage regulator and the second linear voltage regulator;
generating a first regulated voltage, using the first linear voltage regulator and the system power, wherein the first regulated voltage is used as a supply for the voltage reference generation block; and
while keeping the first linear voltage regulator working, generating a second regulated voltage, using the second linear voltage regulator and the system power, wherein the second regulated voltage is used to power a load of the system.

15. The method for voltage regulation according to claim 14, wherein the voltage regulation loop further comprises a voltage buffer and voltage scaling circuit, and wherein the at least one bandgap voltage reference circuit comprises a first bandgap voltage reference circuit that generates a first voltage reference and a second bandgap voltage reference circuit that uses the first regulated voltage to generate a second voltage reference, the method further comprising:
using the voltage buffer and voltage scaling circuit, scaling the first voltage reference to generate a scaled first voltage reference; and
using the soft startup circuit, smoothing the scaled first voltage reference to generate a smooth voltage reference to provide to the linear voltage regulator block;
generating a signal to the control block when Vref2 voltage is correct; and
using the control block, giving a selector control signal to the selector to switch the voltage reference to the soft startup circuit from the scaled first voltage reference to the second voltage reference.

16. The method for voltage regulation according to claim 15, further comprising:

after switching to the second voltage reference, turning off the first bandgap voltage reference circuit to save system quiescent power.

17. The method for voltage regulation according to claim 15, wherein the first voltage reference and the second voltage reference have independent values; and wherein the scaling involves scaling down the first voltage reference to the scaled first voltage reference, such that scaled first voltage reference is smaller than or equal to the first voltage reference and the scaled first voltage reference being equal to the second voltage reference.

18. The method for voltage regulation according to claim 15, wherein the selector is a voltage reference selector, which is used to select a correct voltage reference for the first linear voltage regulator and the second linear voltage regulator, the method further comprising:

using the voltage reference selector to start with the scaled first voltage reference, and then switching over to the second voltage reference once its value is correct.

19. The method for voltage regulation according to claim 14, wherein the at least one bandgap voltage reference circuit has one bandgap voltage reference circuit, wherein the selector is a power supply selector that selects a power supply for the one bandgap voltage reference circuit, the method further comprising:

wherein the providing the system power supply to the one bandgap voltage reference circuit is via the power supply selector;

when the first voltage regulator is working properly, generating a control signal from the control block to the power supply selector to switch a supply of the one bandgap voltage reference circuit from the system power to the first regulated voltage in a smooth manner, in which the power supply selector first passes the system power supply, then it passes both the system power supply and the first regulated power supply for a selected duration, and finally it passes only the first regulated power supply in a final state of the switching.

20. The method for voltage regulation according to claim 19, wherein the control block is responsible for smooth switching by generating appropriate control signals in a select order to the power supply selector.

* * * * *